US009609432B2

(12) United States Patent
Andersen

(10) Patent No.: US 9,609,432 B2
(45) Date of Patent: Mar. 28, 2017

(54) MICROPHONE WITH AUTOMATIC BIAS CONTROL

(75) Inventor: Troels Andersen, Smorum (DK)

(73) Assignee: TDK Corporation, Tokyo (JP)

( * ) Notice: Subject to any disclaimer, the term of this patent is extended or adjusted under 35 U.S.C. 154(b) by 155 days.

(21) Appl. No.: 14/387,708

(22) PCT Filed: Mar. 30, 2012

(86) PCT No.: PCT/EP2012/055829

§ 371 (c)(1),
(2), (4) Date: Jan. 10, 2015

(87) PCT Pub. No.: WO2013/143607

PCT Pub. Date: Oct. 3, 2013

(65) Prior Publication Data

US 2015/0163594 A1 Jun. 11, 2015

(51) Int. Cl.

| | |
|---|---|
| ***H04R 3/04*** | (2006.01) |
| ***H04R 19/04*** | (2006.01) |
| ***H04R 3/00*** | (2006.01) |

(52) U.S. Cl.

CPC ..... *H04R 3/04* (2013.01); *H04R 19/04* (2013.01); *H04R 3/007* (2013.01)

(58) Field of Classification Search

USPC ..... 381/98, 113, 111

See application file for complete search history.

(56) References Cited

U.S. PATENT DOCUMENTS

| | | | | |
|---|---|---|---|---|
| 2003/0133588 | A1 | 7/2003 | Pedersen | |
| 2006/0008097 | A1* | 1/2006 | Stenberg | H04R 19/04 381/113 |
| 2006/0147061 | A1 | 7/2006 | Niwa | |
| 2008/0181437 | A1 | 7/2008 | Suzuki et al. | |
| 2009/0111267 | A1 | 4/2009 | Park et al. | |
| 2010/0013501 | A1* | 1/2010 | Van Den Boom | G01D 3/08 324/679 |
| 2011/0110536 | A1* | 5/2011 | Hovesten | H04R 19/04 381/111 |
| 2011/0142261 | A1 | 6/2011 | Josefsson | |
| 2012/0076339 | A1 | 3/2012 | Buck et al. | |

FOREIGN PATENT DOCUMENTS

| | | | |
|---|---|---|---|
| EP | 1906704 | A1 | 4/2008 |
| EP | 1599067 | B1 | 5/2013 |
| JP | 2007096897 | | 4/2007 |
| JP | 2008205551 | | 9/2008 |
| JP | 2010141762 | | 6/2010 |
| WO | WO/2012/001589 | A2 | 1/2012 |

OTHER PUBLICATIONS

International Search Report corresponding to co-pending International Patent Application Serial No. PCT/EP2012/055829, European Patent Office, dated Jun. 8, 2012, (4 pages).

* cited by examiner

*Primary Examiner* — Duc Nguyen
*Assistant Examiner* — Yogeshkumar Patel
(74) *Attorney, Agent, or Firm* — Nixon Peabody LLP

(57) ABSTRACT

A microphone comprising an automatic bias control providing a better signal quality is proposed. The microphone comprises a bias control circuit that can provide two or more voltages to the microphone's capacitor. The bias control circuit increases the voltage if the collapse frequency is low and decreases the voltage if the collapse frequency is high.

14 Claims, 5 Drawing Sheets

MICROPHONE WITH AUTOMATIC BIAS CONTROL

CROSS-REFERENCE TO RELATED APPLICATIONS

Figure 1:
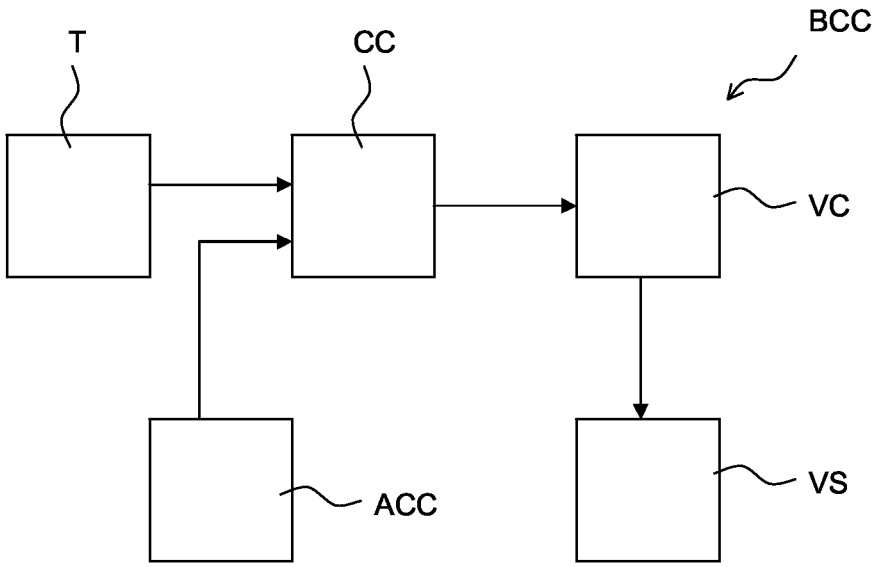

This application is a U.S. National Stage of International Application No. PCT/EP2012/055829, filed Mar. 30, 2012, all of which is incorporated herein by reference in its entirety.

The present invention refers to condenser microphones, e.g. MEMS microphones, in which the voltage between the microphone's capacitor is controlled to obtain an improved sound quality and to methods for manufacturing microphones.

Condenser microphones comprise a backplate and a membrane which act as electrodes of a capacitor. A voltage is applied to the capacitor. Received sound signals cause the membrane to oscillate. By evaluating the capacitor's capacity depending on the distance between the backplate and the membrane, the sound signals can, thus, be converted into electrical signals.

The sensitivity of a microphone depends on factors such as the distance between the capacitor's electrodes and the applied voltage. In order to increase the microphone's sensitivity, the distance between the capacitor's electrodes can be reduced and the voltage can be increased. However, at high sound pressure levels, electrostatic collapses can occur. Then, the membrane and the backplate come into mechanical contact. As the electrostatic force between the electrodes depends reciprocally on the distance d between the electrodes, the restoring force of the—flexible—membrane is usually not large enough to restore the capacitor's air gap. Thus, the bias voltage has to be removed in order to restore an equilibrium distance. For that, conventional microphones can comprise an anti-collapse circuit. However, each time the bias voltage is removed, the microphone is unable to convert sound signals into electrical signals. Thus, audible artifacts are obtained whenever such a collapse occurs. Especially at high sound pressure levels, these artifacts strongly reduce the microphone's sound quality.

A further means to prevent the membrane being "pulled in" towards the backplate is to provide protrusions on the backplate in order to maintain a minimum distance between the membrane and the backplate's main surface. However, such protrusions limit the amplitude of the membrane's oscillation resulting in a reduced dynamic range.

It is an object of the present invention to provide a microphone with reduced audible artifacts, especially at high sound pressure levels, which has high sensitivity at normal sound pressure levels. It is a further object to provide a microphone in which the probability of future collapses is reduced. Another object is to provide a method for driving such a microphone.

Therefore, a microphone according to independent claim 1 is provided. Dependent claims provide advantageous embodiments.

For that, a microphone comprises a capacitor with a backplate and a membrane. The microphone further comprises a voltage source applying a voltage to the capacitor and a bias control circuit. The bias control circuit determines the collapse frequency of the capacitor. The bias control circuit can provide at least two voltages larger than 0 V. The bias control circuit increases the voltage if the collapse frequency is low and decreases the voltage if the collapse frequency is high.

In other words, the microphone's bias voltage is adjusted based on how often the microphone collapses.

Thus, a microphone is provided in which the bias voltage of the microphone's capacitor depends on the actual collapse frequency being a measure for the sound pressure level. At high sound pressure levels, the bias voltage is reduced. As a result, the collapse frequency is decreased and the number of audible artifacts is reduced. Thus, the microphone's signal quality is improved although the microphone's sensitivity is reduced.

At normal sound pressure levels or at low sound pressure levels, the bias voltage is increased and the microphone's high sensitivity is restored. Then, the signal quality of the microphone is good as no audible artifacts are to be expected.

Here, collapse frequency denotes the number of electrostatic collapses in a predefined time interval.

The bias control circuit can be able to remove the voltage completely in order to detach the membrane from the backplate if a collapse has occurred.

For that, the microphone can comprise an anti-collapse circuit such as an anti-collapse circuit of known microphones.

Thus, a microphone is obtained in which the probability of future collapses, resulting in audible artifacts, is strongly reduced.

In one embodiment, the microphone's bias control circuit increases the voltage if the collapse frequency is lower or equal to a first frequency, and decreases the voltage if the collapse frequency is higher or equal to a second frequency.

Thus, the first frequency and the second frequency define threshold frequencies that, when reached, trigger measures—the increase or decrease of the microphone's voltage—to reduce audible artifacts or to increase the microphone's sensitivity.

In one embodiment, the bias control circuit comprises a timer, a collapse counter, an anti-collapse circuit, and a voltage controller.

The anti-collapse circuit can be a conventional anti-collapse circuit which temporarily removes or strongly reduces the bias voltage to separate the membrane from the backplate. The timer and the collapse counter can be utilized to determine the collapse frequency. Then, the collapse frequency can be determined by dividing the counted number of collapses by the respective time interval. The voltage controller controls the voltage source, correspondingly.

In one variant of this embodiment, the timer, therefore, provides a timer signal of a timer frequency Ft which defines a timer period $\Delta t$ and where $\Delta t=1/Ft$. The collapse counter counts the number of collapses and may be reset after each timer signal. The collapse counter may be a device or circuit having a counter value, e.g. in a memory, being incremented or decremented at each collapse.

The voltage controller reduces the voltage if the number of counted collapses of a timer period $\Delta t$ exceeds a first critical number and increases the voltage if the number of counted collapses of a timer period $\Delta t$ falls below a second critical number.

Thus, a microphone which can be driven with a simple algorithm is provided. In a loop, the appearance of the timer signal is expected. Meanwhile, the number of occurred collapses within the specific time period is counted. If the number of counted collapses exceeds the critical number, then the voltage is reduced and the next timer period can be started. However, if the timer period $\Delta t$ expires and the number of counted collapses falls below a second critical number, the voltage is increased in order to enhance the microphone's sensitivity.

Further, it is possible to maintain the voltage if the number of counted collapses per timer period is within an interval of acceptable collapse frequencies. Such an interval can be defined by the first and the second critical number.

The number of provided voltages is not limited to 2 voltages being larger than 0 V. The microphone or the voltage source can provide n voltages larger than 0 V where the first critical number and the second critical number depend on the voltage. Here, n is a integer number larger than or equal to 3, 4, 5, 6, . . . .

Thus, the microphone can comprise a plurality of voltage stages between which the bias control circuit can change depending on the collapse frequency and/or the counted collapse number.

It is possible that the second critical number of a stage i equals the first critical number of stage i+1.

In one embodiment, the timer period Δt depends on the variation rate of the voltage.

Then, high variation rates can result in short timer periods Δt and low variation rates can result in larger timer periods Δt. The variation rate is defined as the change in voltage divided by a time of unit length. Accordingly, the critical numbers can be adjusted to the new timer period Δt.

In one embodiment, the bias control circuit varies the voltage in discrete steps.

Such an embodiment can be realized with a digital integrated circuit. Then, the timer period Δt can be defined as the time of a certain number of clock cycles triggering the digital integrated circuits.

In one embodiment, however, the bias control circuit comprises analog circuit elements. These analog circuit elements can comprise integrators to determine the respective timer periods Δt and to determine the number of collapses or to directly determine the collapse frequency. These analog circuit elements can comprise means for calculating the voltages' variation rate.

In one embodiment, the backplate of the membrane comprises protrusions, e.g. studs, to prevent larger areas' stiction of the membrane to the backplate. Compared to conventional microphones, the protrusions' length can be reduced in order to obtain a better dynamic range.

A method for driving a condenser microphone comprises the steps:

providing a periodic timer signal defining a timer period Δt, counting the number of collapses per timer period, determining the voltage variation rate based on the counted collapses per timer period Δt.

Then, when the bias voltage is to be maintained, the voltage variation rate could be set to zero. If the voltage is to be increased, the voltage variation rate can be set to a positive value and if the voltage is to be reduced, the voltage variation rate can be set to a negative value. The voltage variation rate can be varied in discrete steps or continuously.

The basic idea of the present invention and examples of such microphones are shown in the schematic figures.

SHORT DESCRIPTION OF THE FIGURES

Figure 2:
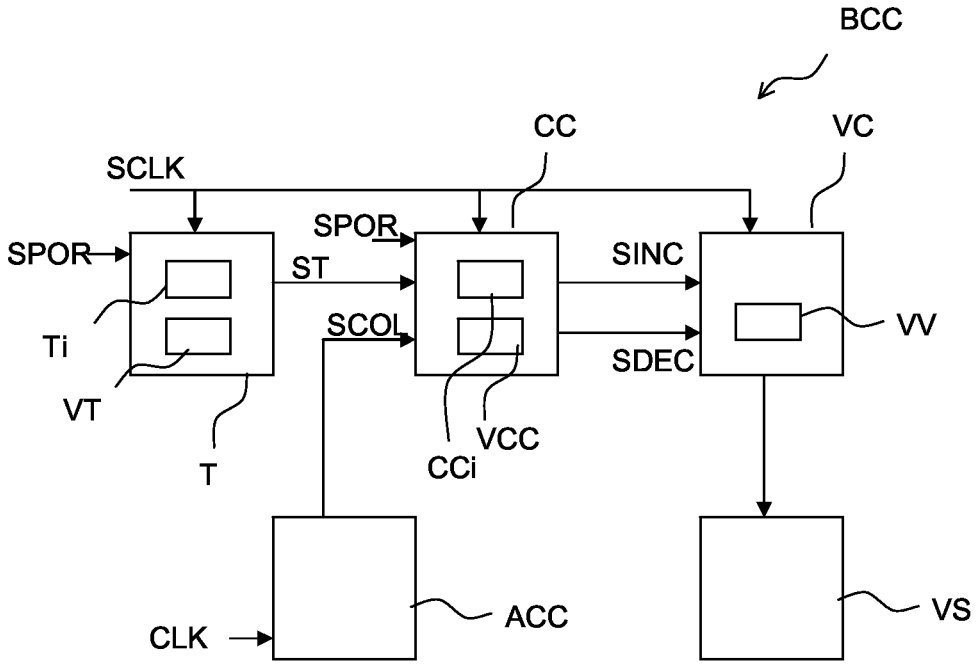
Figure 3A:
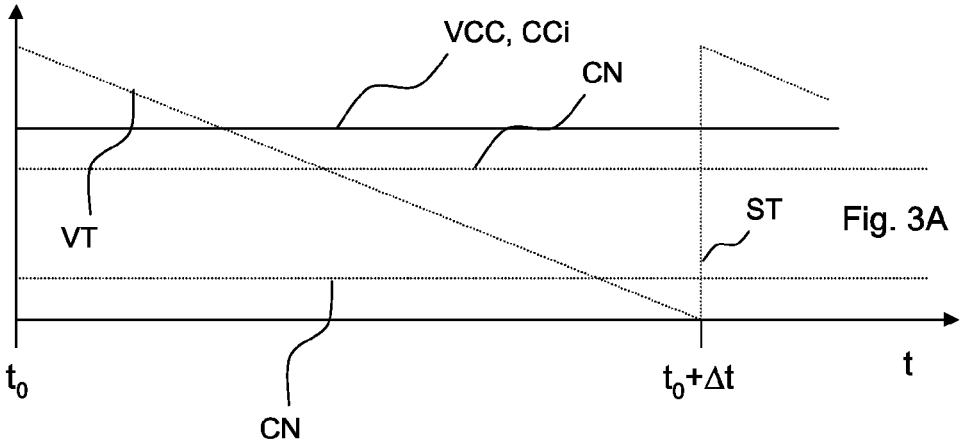
Figure 3B:
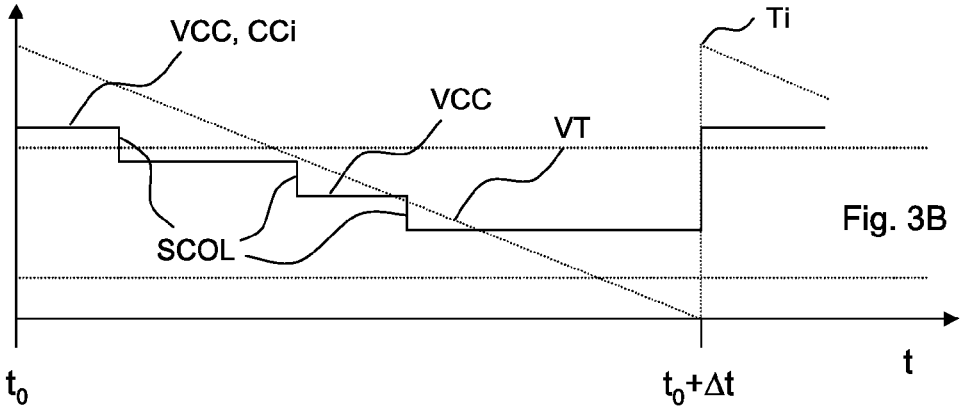
Figure 3C:
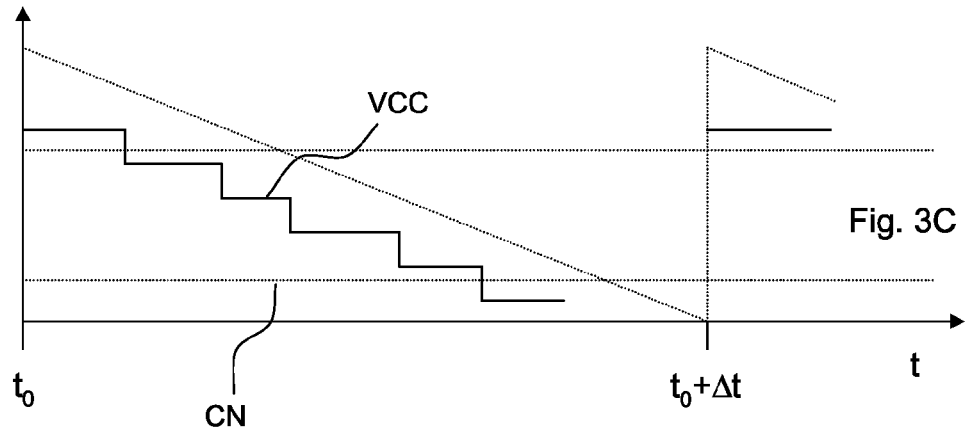
Figure 4A:
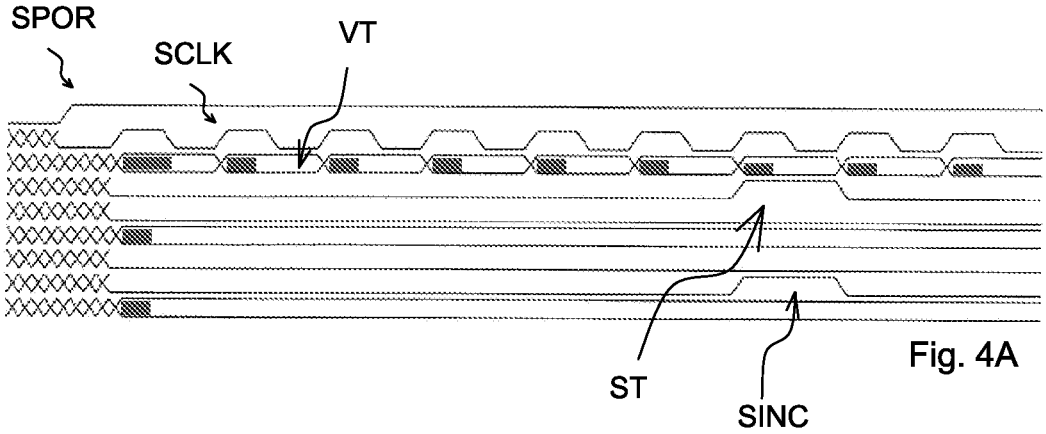
Figure 4B:
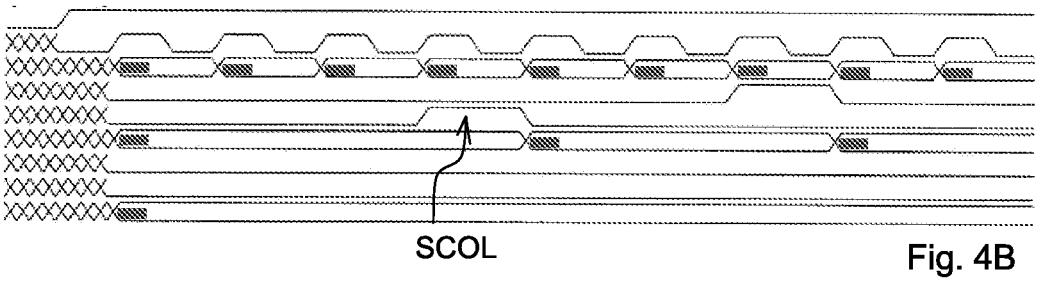
Figure 4C:
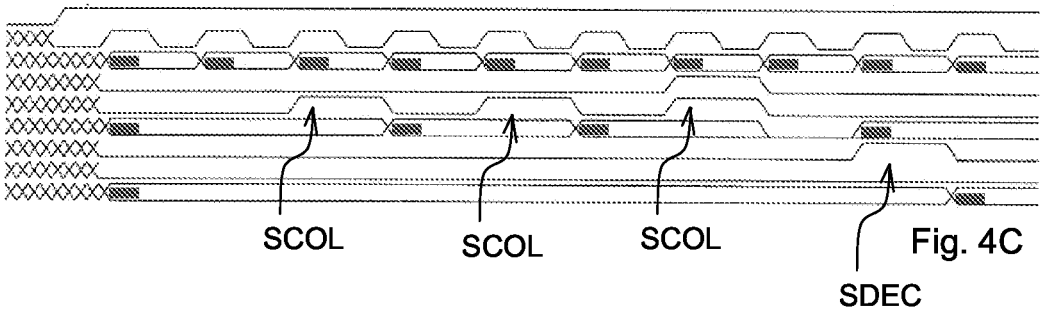
Figure 4D:
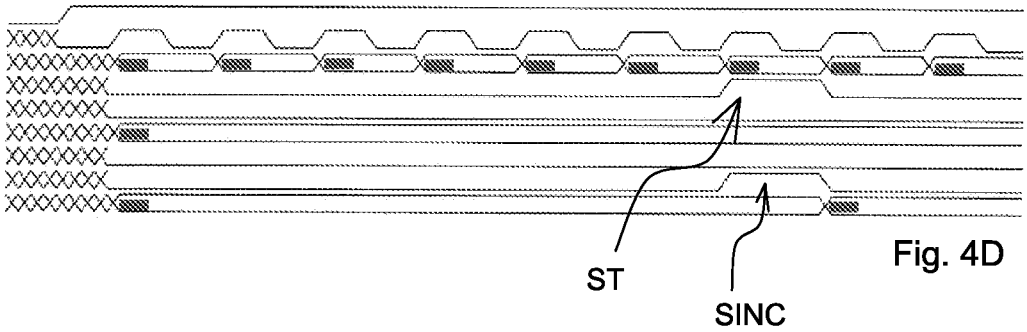
Figure 5:
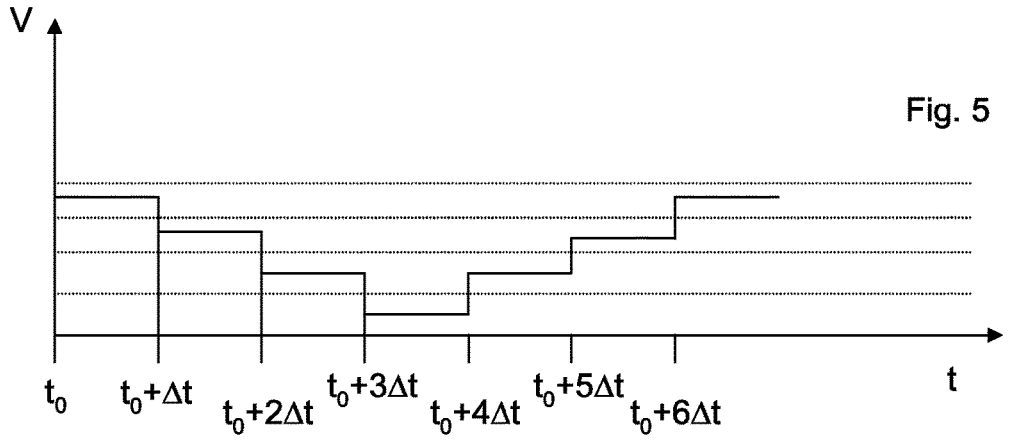
Figure 6:
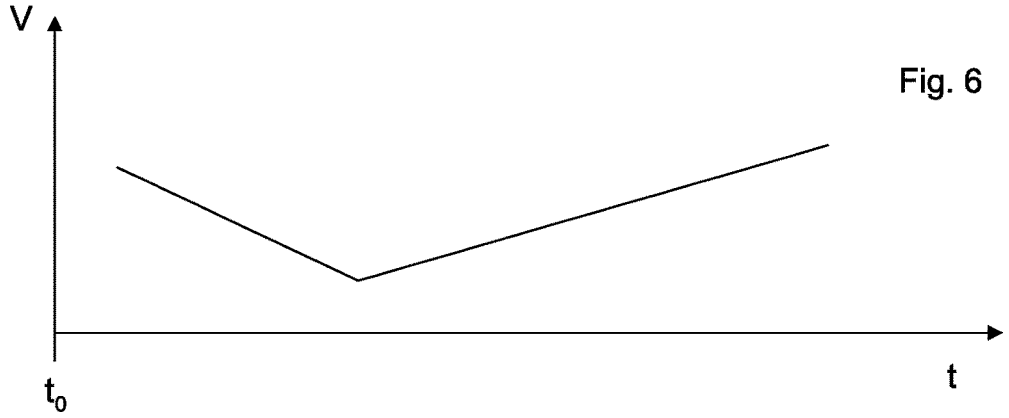
Figure 7:
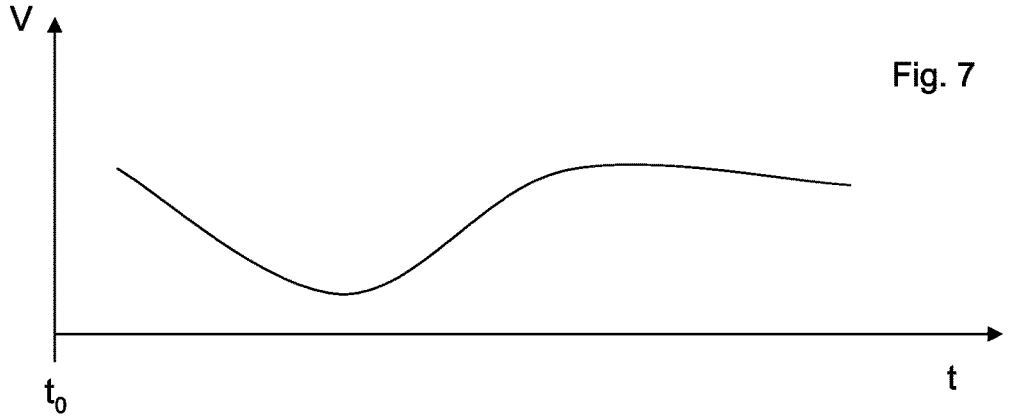
Figure 8:
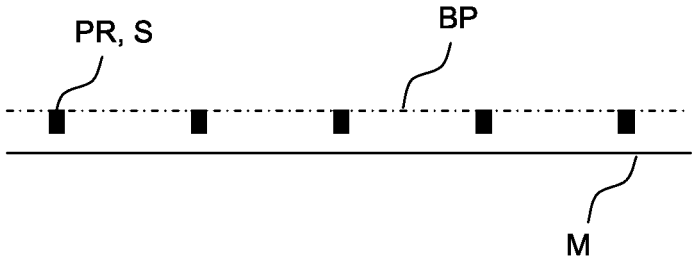
Figure 9:
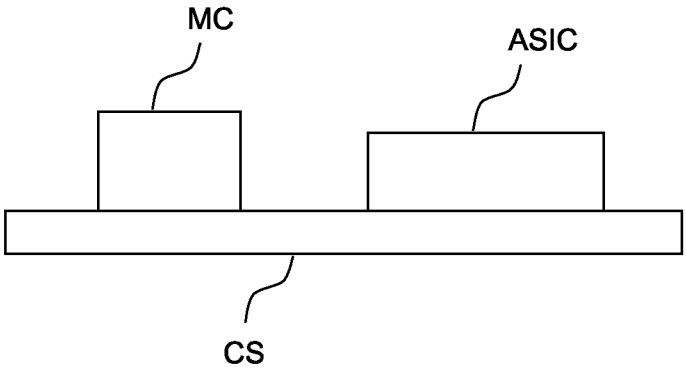

FIG. 1 shows a bias control circuit BCC comprising a timer T, a collapse counter CC, a voltage controller VC, an anti-collapse circuit ACC, and a voltage source VS, FIG. 2 shows further elements of a bias control circuit BCC, FIG. 3A shows a timer period of duration Δt in which no collapse occurs, FIG. 3B shows a timer period in which the number of collapses is between a first critical number and a second critical number, FIG. 3C shows a time period in which the number of collapses exceeds the second critical number, FIG. 4A shows a signal diagram indicating no collapse, FIG. 4B shows a signal diagram indicating a single collapse, FIG. 4C shows a signal diagram indicating three collapses, FIG. 4D shows a signal diagram indicating no collapse and a voltage increment signal, FIG. 5 shows the bias voltage varying over a plurality of time periods in discrete steps, FIG. 6 shows a bias voltage being controlled continuously, FIG. 7 shows a bias voltage being controlled according to a differentiable function, FIG. 8 shows a cross-section through a microphone's capacitor, FIG. 9 shows a cross-section of a microphone comprising chips on a substrate.

FIG. 1 shows schematically a bias control circuit BCC. The bias control circuit BCC comprises a timer T, a collapse counter CC, a voltage controller VC, an anti-collapse circuit ACC, and a voltage source VS. Arrows indicate the direction of information transmitted from one unit of the bias control circuit to another unit. The anti-collapse circuit ACC provides the collapse counter CC with a collapse signal every time an electrostatic collapse is detected. Further, the anti-collapse circuit ACC is able to remove the voltage from the microphone's capacitor in order to restore the equilibrium distance between the backplate and the membrane. The timer T provides time information that is necessary to determine the collapse frequency. Thus, the timer T may provide a timer signal every time a timer period Δt has elapsed. Depending on the determined collapse frequency, the collapse counter may provide the number of collapses per time period to the voltage controller VC. However, it is possible that the collapse counter directly generates a signal that allows the voltage controller to either increase, decrease or maintain the bias voltage. The voltage controller VC controls the voltage source VC that applies the bias voltage to the capacitor. The voltage source VS may comprise a voltage pump, e.g. a programmable voltage pump.

The bias control circuit BCC may work in a continuous mode continuously controlling the bias voltage. However, it is possible for the bias control circuit BCC to perform discrete steps to control the bias voltage.

FIG. 2 schematically shows an embodiment of a bias control circuit BCC in which a clock signal SCLK is applied to the timer T, the collapse counter CC, the voltage controller VC, and the anti-collapse circuit ACC. Further, timer T and the collapse counter CC can be provided with a power-on reset signal SPOR triggering an initialization process of the respective units.

The bias control circuit of FIG. 2 utilizes discrete steps to control the bias voltage. Such a circuit can easily be implemented as integrated circuit elements within an IC chip.

Timer T comprises a memory cell for storing an actual timer value VT and further comprises a memory cell to store an initializing timer value Ti. The clock signals SCLK are counted, for example by incrementing or decrementing the timer value VT on each clock signal SCLK. When the number of counted clock signals SCLK exceeds the initial timer value Ti, a timer signal ST is submitted to the collapse counter CC. It is possible that initially the timer value VT is set to the initial timer value VI. Every time a clock signal CLK is received, the timer value VT is decremented. When the timer value VT reaches zero, the timer signal ST is emitted and the—actual—timer value VT is reset to the initial timer value Ti.

Every time the anti-collapse circuit ACC detects a collapse, a collapse signal SCOL is transmitted to the collapse counter CC. The number of collapse signals SCOL is counted. For that, the collapse counter CC comprises a memory cell, the value of which is changed—e.g. incremented or decremented—every time a collapse signal SCOL is received. Further, the control circuit CC comprises a memory cell for a critical number of collapses CCi. When the power-on reset signal SPOR is received, the value of the collapse counter VCC is set to the initialized value CCi. Every time the anti-collapse circuit ACC sends a collapse signal SCOL to the collapse counter CC, the number of collapses is incremented, i.e. VCC is decremented.

When the collapse counter CC receives a timer signal ST before receiving a collapse signal SCOL, an increment signal SINC is transmitted to the voltage controller VC. The voltage controller VC comprises a memory cell containing the voltage value VV. When the voltage value VV is at its maximum value nothing happens. If the voltage value VV is below its maximum value, the voltage value is increased.

When the value of the collapse counter VCC was decremented to zero before a timer signal ST is received, the collapse frequency is regarded as high and a decrement signal SDEC is transmitted to the voltage controller VC. Unless the voltage value VV of the voltage controller VC has reached its minimum value, the voltage value VV is decreased.

When the collapse counter CC receives a timer signal ST when a few collapses have occurred but the value of the collapse counter VCC contains still a positive value, then a balanced state between a high bias voltage and a low number of acoustic artifacts is obtained; the bias voltage is within an optimal area.

The initial value of the timer Ti determining the length of the timer period can depend on the bias voltage according to the voltage value VV, the current bias voltage adjustment rate, or other external factors. The initial value of the collapse counter CCi can depend on the actual bias voltage or the bias voltage adjustment rate.

Thus, a bias control circuit BCC is provided that can be driven with a simple and, thus, stable algorithm which bases on counting clock signals and counting collapse signals, decrementing integer values and comparing whether such an integer value—timer value VT and collapse counter value VCC—equals zero.

Thus, such an algorithm can be implemented with simple circuit elements, e.g. in an integrated circuit chip.

FIG. 3A shows a timer period of length Δt in which a value of the timer VT is decreased from a predefined value to zero. The value of the collapse counter VCC remains at its initial value CCi as no collapse events are received. Two critical numbers CN determine the behavior of the bias voltage control circuit BCC. When the number of collapses within the timer period is below a first critical number—represented by the upper critical number CN in FIG. 3A, then the collapse frequency is low and the bias voltage can be increased unless it has already reached its maximum value.

When the counted collapse number exceeds a second critical value—represented by the lower critical number CN in FIG. 3A—the collapse frequency is high and the bias voltage is reduced unless the bias voltage has reached its minimum value.

When the number of collapses is between the critical numbers, it can be assumed that the collapse frequency is in its optimum range and the bias voltage can be maintained.

FIG. 3B shows the situation in which three collapse signals SCOL are counted within the timer period Δt. After expiration of the timer signal, the counted collapse number VCC is between the first critical number and the second critical number. Thus, the bias voltage can be maintained. No action is required.

FIG. 3C shows a timer period Δt in which five collapse signals are counted before the timer interval expires. Thus, the number of counted collapses exceeds the second critical value—represented by the lower critical value CN in FIG. 3C—and a decrement signal is transmitted to the voltage controller VC.

It is possible for the timer to reset the timer value VT when reaching zero. However, it is possible to reset the timer value to its initial value when the decrement signal is transmitted.

In order to fully understand FIGS. 3A-3C it is to be understood that the number of collapses can be counted by decrementing a value instead of incrementing. Then, the number of collapses equal the absolute value of the difference between the actual counter value and its initial value. Counting by decrementing has the advantage that zero as a critical counter value can easily be verified by digital circuits.

FIGS. 4A-4D show signal events of nine signal lines, each signal line being represented by one of the nine rows.

The first row shows the power-on request signal SPOR initializing the bias control circuit BCC.

The second row shows the clock signal SCLK.

The third row shows the value of the timer VT.

The fourth row shows the timer signal ST emitted by the timer T when the time period Δt has expired.

The fifth row shows the signal transmitted by the anti-collapse circuit to the collapse counter SCOL when a collapse is detected.

The sixth row shows the value of the collapse counter VCC.

The seventh row shows the decrement signal SDEC transmitted by the collapse counter CC to the voltage controller VC when the number of collapses exceeded the second critical number before the time period Δt ends.

The eighth row shows the increment signal SINC transmitted from the collapse counter CC to the voltage controller VC when the number of counted collapses falls below the first critical number and the timer period expired.

The ninth row shows the value of the bias voltage VV.

In FIG. 4A, the timer signal ST is emitted after six periods of the clock signals SCLK. As within this time period no collapse—compare fifth row—occurred, an increment signal SINC—compare eighth row—is transmitted to the voltage controller VC.

FIG. 4B shows a timer period in which a single collapse is detected and a respective collapse signal SCOL is transmitted to the collapse counter CC. Thus, the value of the collapse counter—compare row 5—is decremented. As this is the only collapse detected within the timer period, neither a decrement nor an increment of the bias voltage is necessary. Further, after expiring of the timer interval—compare third row—the value of the collapse counter is restored to the initial collapse counter value CCi.

FIG. 4C shows a timer period in which three collapses are detected and corresponding collapse signals SCOL are transmitted to the collapse counter. Further, on every detected collapse, the value of the collapse counter VCC is decremented—compare row 6.

Here, the number of counted collapses exceeds the second critical number and a decrement signal SDEC—compare row 7 is transmitted to the voltage controller VC. As a result, the voltage value VV of the voltage controller VC is also decremented—compare row 9.

FIG. 4D shows a time interval in which no collapse is detected. Thus, an increment signal SINC—compare row 8—is transmitted to the voltage controller VC. As the bias voltage has not reached its maximum value, the value of the voltage VV is incremented—compare row 9.

FIG. 5 shows a plurality of consecutive expiring timer intervals. FIG. 5 shows an embodiment in which five values for the bias voltage are allowed. Within the first period, a collapse occurs and the anti-collapse circuit removes the bias voltage from the capacitor. Then, the bias voltage is reduced by a discrete step and reapplied to the capacitor. Within the second period, another collapse occurs and the bias voltage is again decreased. Within the third period, a third collapse occurs and the bias voltage reaches its minimum value. Then, the sound pressure level decreases and no further collapses occur. Accordingly, the bias voltage can be increased after each timer period.

FIG. 6 shows an embodiment of the bias control circuit in which the bias voltage is not controlled in discrete steps, e.g. such as shown in FIG. 5, but continuously. It is possible to vary the bias voltage according to a linear function. For that, the bias voltage can be decreased or increased with individual rates.

Control of the bias voltage is not limited to linear functions. FIG. 7 shows an embodiment in which the bias control voltage is controlled according to differentiable functions, e.g. polynoms, e.g. quadratic functions or quadratic or cubic splines.

Stepwise—i.e. in discrete steps—control of the bias voltage may be preferred when utilizing digital bias control circuits. However, using analog control circuits, comprising e.g. integrating circuits or differentiating circuits, may result in still better converging bias voltages. Then, the number of acoustic artifacts—audible artifacts—is further reduced and the microphone's sensitivity is further improved.

FIG. 8 shows a cross-section of a microphone's capacitor comprising a backplate BP and a flexible membrane M. Protrusions PR, e.g. studs S, are arranged on the backplate BP. Thus, the membrane M and the backplate BP can more easily be separated after a collapse.

FIG. 9 shows a cross-section of a microphone in which a microphone chip MC comprising the capacitor and an IC chip, e.g. an ASIC chip (ASIC=Application-Specific Integrated Circuit) are arranged on a carrier substrate CS. The microphone's element of the acoustically active region, the backplate BP and the membrane M can be established by MEMS (MEMS=Micro-Electro-Mechanical Systems) elements in a MEMS chip.

A microphone is not limited to the embodiments described in the specification or shown in the figures. Microphones comprising further elements such as further circuits, capacitors, membranes, backplates, active or passive circuit components or combinations thereof are also comprised by the present invention.

LIST OF REFERENCE SIGNS

ACC: anti-collapse circuit
ASIC: ASIC chip
BCC: bias control circuit
BP: backplate
CC: collapse counter
CCi: initial collapse counter value
CN: critical number
CS: carrier substrate
M: membrane
MC: MEMS chip
PR: protrusion
S: stud
SCLK: clock signal
SCOL: collapse signal
SDEC: decrement signal
SINC: increment signal
SPOR: power-on reset signal
ST: timer signal
t: time
T: timer
Ti: initial timer value
V: bias voltage
VC: voltage controller
VCC: collapse counter value
VS: voltage source
VT: timer value
VV: voltage value
Δt: timer period

The invention claimed is:

1. A microphone, comprising:

a capacitor with a backplate and a membrane, a voltage source applying a voltage to the capacitor, a bias control circuit, where the bias control circuit determines the collapse frequency of the capacitor, the bias control circuit can provide two voltages>0 V, the bias control circuit increases the voltage if the collapse frequency is low and decreases the voltage if the collapse frequency is high, wherein the collapse frequency is a function of how often the capacitor of the microphone collapses in a time period, and wherein increasing the voltage if the collapse frequency is low enhances the sensitivity of the microphone, and wherein decreasing the voltage if the collapse frequency is high reduces a number of audible artifacts produced by the microphone.

2. The microphone of claim 1, where the bias control circuit increases the voltage if the collapse frequency is lower or equal to a first frequency and decreases the voltage if the collapse frequency is higher or equal to a second frequency.

3. The microphone of claim 1, where the bias control circuit comprises a timer, a collapse counter, an anti collapse circuit, and a voltage controller.

4. The microphone of claim 3, where the timer provides a timer signal of a timer frequency Ft defining a timer period Δt=1/Ft, the collapse counter counts the number of collapses after each timer signal, the voltage controller reduces the voltage if the number of counted collapses of a timer period Δt exceeds a first critical number, the voltage controller increases the voltage if the number of counted collapses of a timer period Δt falls below a second critical number.

5. The microphone of claim 4, providing n voltages>0, where the first critical number and the second critical number depend on the voltage, and n is a integer number>=3.

6. The microphone of claim 4, where the timer period Δt depends on the variation rate of the voltage.

7. The microphone of claim 1, where the voltage is a function of the collapse frequency.

8. The microphone of claim 1, where the bias control circuit varies the voltage in discrete steps.

9. The microphone of claim 1, where the bias control circuit varies the voltage continuously.

10. The microphone of claim 9, where the bias control circuit comprises analog circuit elements.

11. The microphone of claim 1, where the backplate or the membrane comprises protrusions.

12. Method for driving a microphone, comprising the steps of:

providing a periodical timer signal defining a timer period Δt, wherein the number of collapses is a function of how often a capacitor of the microphone collapses in the timer period, counting the number of collapses per timer period, determining the voltages variation rate based on the counted collapses per timer period Δt, and increasing the voltage to the capacitor if the number of collapses is low to enhance the sensitivity of the microphone or decreasing the voltage to the capacitor if the number of collapses is high to reduce a number of audible artifacts produced by the microphone.

13. The microphone of claim 1, wherein the first frequency is such that increasing the voltage causes an enhancement in the sensitivity of the microphone, and the second frequency is such that decreasing the voltage causes a reduction in the number of audible artifacts.

14. The microphone of claim 2, wherein the bias control circuit maintains the voltage if the collapse frequency is between the first frequency and the second frequency.

* * * * *